United States Patent [19]

Block et al.

[11] Patent Number: 4,462,530

[45] Date of Patent: Jul. 31, 1984

[54] HIGH SPEED INDEXING SYSTEM

[75] Inventors: Charles Block, North Bellmore; Leon Mintz, Syosset, both of N.Y.

[73] Assignee: Joseph Galkin Corporation, Hicksville, N.Y.

[21] Appl. No.: 293,762

[22] Filed: Aug. 17, 1981

Related U.S. Application Data

[63] Continuation of Ser. No. 110,100, Jan. 7, 1980, abandoned, which is a continuation of Ser. No. 772,061, Feb. 25, 1977, Pat. No. 4,182,251.

[51] Int. Cl.[3] ..... B65H 17/22

[52] U.S. Cl. ..... 226/156; 112/320; 112/322

[58] Field of Search ..... 226/156, 157, 148, 152; 112/318, 319, 322, 320

[56] References Cited

U.S. PATENT DOCUMENTS

| | | | |
|---|---|---|---|
| 1,687,524 | 10/1928 | Smith | 226/157 |
| 2,311,903 | 2/1943 | Wilcox | 226/156 X |
| 2,638,132 | 5/1953 | Guess | 226/157 X |
| 2,819,070 | 1/1958 | Herr | 226/156 |
| 2,904,167 | 9/1959 | Guess | 226/157 |
| 2,947,537 | 8/1960 | Littell et al. | 226/156 |
| 3,083,658 | 4/1963 | Winberg | 112/322 |
| 3,104,639 | 9/1963 | Reeber | 112/322 |
| 3,625,168 | 12/1971 | Palazzo | 112/318 |
| 3,747,827 | 7/1973 | Stanton | 112/322 X |
| 3,948,195 | 4/1976 | Chudner | 112/322 |
| 4,020,776 | 5/1977 | Haff, Jr. | 112/319 X |
| 4,065,043 | 12/1977 | Ohashi | 112/318 X |

FOREIGN PATENT DOCUMENTS

| | | | |
|---|---|---|---|
| 528029 | 7/1956 | Canada | 226/156 |
| 204868 | 9/1939 | Switzerland | 226/156 |

*Primary Examiner*—Stanley N. Gilreath
*Attorney, Agent, or Firm*—Paul J. Sutton

[57] ABSTRACT

The present invention teaches a high-speed indexing system for use with any number of fabric-moving apparatus, a novel braking system for use within the indexing system, and a novel puller accessory. The high-speed adjustable indexing system is illustrated in connection with a sewing machine, as an example. In sewing machine applications, a synchronized intermittent advancement of fabric in unison with the movement of an associated feed dog is provided. Undesirable inertia-caused roller overshooting, heretofore treated with anti-reverse clutches and other approaches, is eliminated, thereby enabling high speed indexing at machine operating speeds conventionally unattainable in the art. An adjustable spring-biased braking arrangement is provided which may be preset for known machine operating speeds.

1 Claim, 11 Drawing Figures

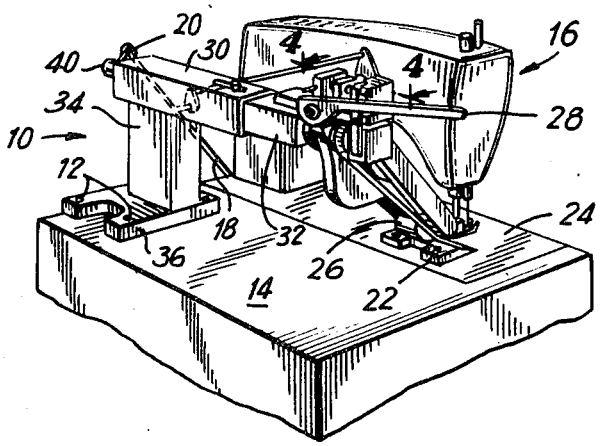
FIG. 1
FIG. 4
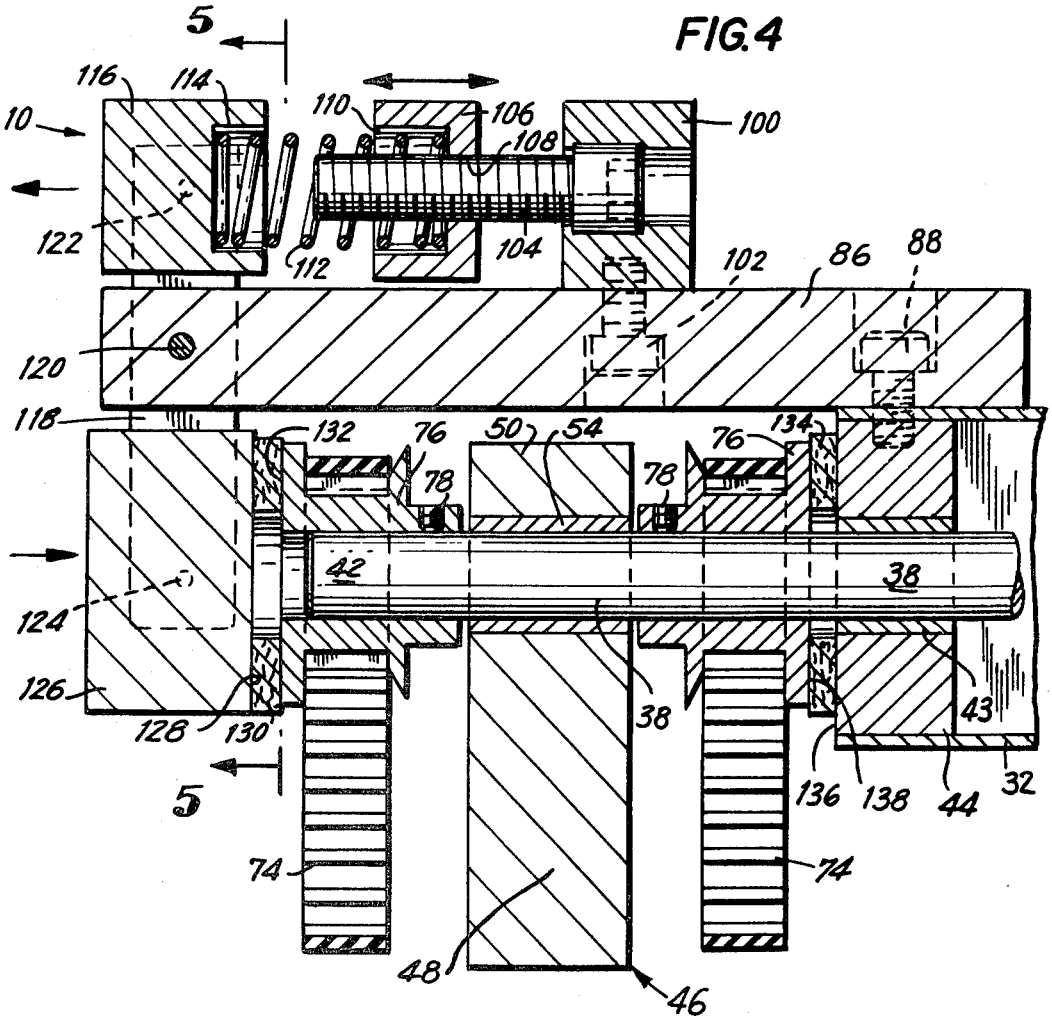

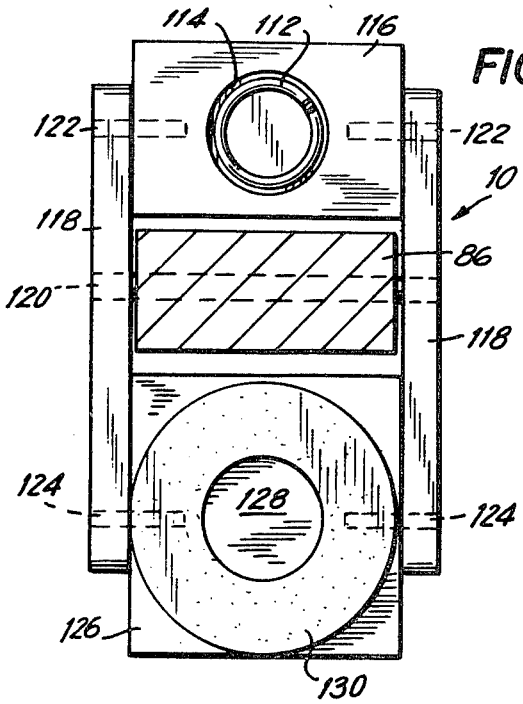
FIG.5
FIG.9
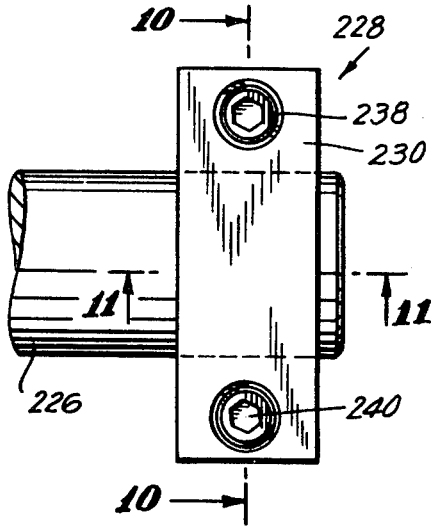
FIG.10
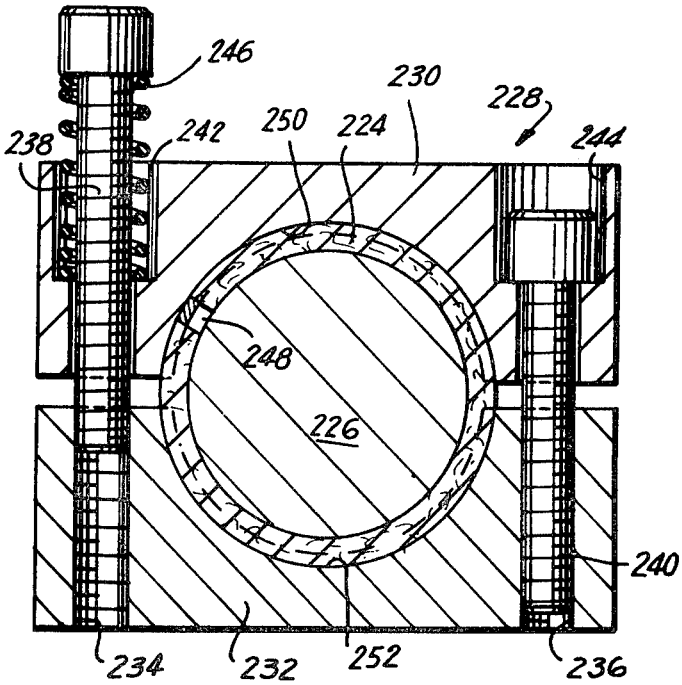
FIG.11
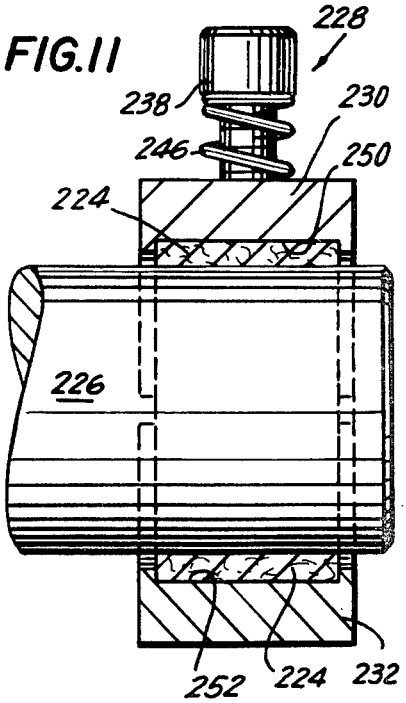

HIGH SPEED INDEXING SYSTEM

This application is a continuation of application Ser. No. 110,100, filed Jan. 7, 1980, now abandoned, which is a continuation of application Ser. No. 772,061, filed Feb. 25, 1977, now U.S. Pat. No. 4,182,251.

The present invention relates generally to apparatus used to move and perform functions upon fabric, or the like, and more particularly to a system capable of providing the user with relatively high-speed, reliable indexing of same, such as in association with pullers, as an example.

BACKGROUND OF PRIOR ART PROBLEMS

As has been stated in prior art patents and in industry literature, the sewing machine industry has consistently sought ways by which to increase both sewing speeds as well as the speeds with which fabrics can be handled. Higher speeds, with associated higher product output, especially in the industrial marketplace, will result in higher profits.

Traditional types of aids or sewing machine accessories, include the puller, which was invented in 1934 by Joseph Galkin and his associates, and which has been marketed since by the Joseph Galkin Corporation. Pullers have been used to overcome a natural deficiency in the way a sewing machine feed dog moves multiple layers of cloth or fabric. It is known that the feed dog will tend to push the lowest layer of cloth or fabric while the machine presser foot tends to retard the forward movement of the upper layer of cloth, with the result that the cloth must be dragged under and against the stationary presser foot. This drag causes the upper layer to slip with respect to the lower layer, with the result that a progressive loss of alignment is realized as the seam is sewn. The longer the seam, the worse this problem becomes.

Pullers are also useful in feeding heavier materials where conditions are such that top and bottom layers may slip. Various schemes have been devised to overcome the problem, such as "walking" presser feet, the substitution of a roller for the presser foot, and pulling mechanisms of the type disclosed in U.S. Pat. No. 3,960,097 granted on June 1, 1976 and entitled High Speed Gearless Fabric Puller. Other U.S. patents that may be of interest include U.S. Pat. Nos. 2,037,088; 2,231,648; 3,083,658; and 3,141,428. The reader is also referred to British Pat. No. 528,684.

While the present invention should in no way be construed as being limited to pullers but, on the contrary, is usable in concept with any type of indexing mechanism wherein inertia problems exist, it will be helpful to the reader to set forth here some of the background of this area in the industry.

Pullers may be classified in several ways, the most important factor being whether the rollers are driven continuously by the sewing machine during the sewing operation, or intermittently in synchronism with the feed dog. Another variable is the manner in which the rollers are driven. On some rollers, only the upper roller is driven; on others the lower roller only is driven; and on superior units both rollers are used to advance the cloth or fabric. In all of these cases, the speed at which the puller can function satisfactorily is critical.

Continuously driven pullers, as opposed to synchronized pullers, have been in the past most useful on light and flexible fabrics where the fabric is able to stretch to compensate for the fact that the feed dog feeds the fabric intermittently and only when the needle is out of the fabric, while the puller is feeding the fabric continuously. Obviously, the fabric must stretch while the needle is in the cloth and the foot is not feeding. If the fabric is unable to stretch, the cloth will slip. Slipping may occur at the feed dog or at the puller rolls or, in some cases, at both places. When the cloth slips at the feed dog, the needle which is in the cloth at the time will bend and may break by rubbing against the needle plate or other machine part. Needle damage of this sort can be alleviated by increasing the presser foot pressure, and reducing pressure on the puller rolls. However, this will cause slipping to take place at the puller such that the puller will be unable to perform its functions satisfactorily.

Synchronized pullers tend to solve the problem of stretching or slipping of cloth by utilizing feed rolls that are moved intermittently in unison with the feed dog. Since the cloth is not being pulled when the needle is in it, slippage or stretching is not required. However, at relatively higher speeds, yet another problem comes into play, which concerns itself with the inherent inertia of the mechanism being utilized to handle and perform functions on the fabric.

By the term "inertia", what is referred to is the natural tendency of the actual physical mechanism employed in moving the fabric to resist both acceleration and deceleration. This problem manifests itself during attempts to cause puller feed rolls to advance intermittently every time a stitch is taken. The rollers and the rest of the associated puller mechanism must be started and stopped. This is more of a problem in the stopping of the feed rolls positively, as opposed to the starting of the rolls. When the rolls are moved at higher speeds, one experiences the consequences of Newton's law wherein the difficulty of stopping the feed rollers increases as a function of the square of the operating speed. As long as one is sewing at relatively slower speeds- for example, under 1,500 stitches per minute (spm)- conventional puller designs do not have too much trouble in stopping. However, at the upper spectrum of relatively higher operating speeds, if we double the speed one experiences the difficulty of stopping the rolls which is perhaps four times harder.

If puller feed rolls are not stopped substantially precisely at the end of each feed dog's cycle, the feed roll overshoots or, in more common parlance, turns a bit more than desired. This additional turning, while small, occurs erratically and will vary with speed and puller adjustment. The result is the undesirable varying of stitch size and slipping.

Efforts to deal with this problem have in many cases resulted in operating at speeds far below the speed capability of the sewing machine being employed. Until developments such as that disclosed within U.S. Pat. No. 3,960,097, running at relatively slower speeds was a choice chosen by most in the industry. And yet, a growing need exists for machine speeds of 6,000 to 8,500 stitches per minute, as opposed to conventional speeds of 3,500–4,000 stitches per minute.

Accordingly, it is an object of the present invention to provide an adjustable high-speed indexing system capable of use with any number of different rotating apparatus wherein inertia problems interfere with high speed indexing.

Another object of the present invention is to provide an adjustable high speed indexing system wherein, by knowing the running speed of a customer's sewing machine, appropriate parameters can be calculated so as to adjust by spring pressure certain braking means within the system.

Yet another object of the present invention is to provide a combined brake and clutch mechanism which, within an adjustable indexing system, will substantially eliminate inertial overshooting problems.

Still another object of this invention is to provide a puller attachment, or the like, which is equipped with high speed adjustable indexing means wherein a novel braking system is utilized which provides for dissipation of heat between a brake-lining member and a surrounding heat sink.

Yet another object of the present invention is to provide a puller or similar device, as above, whereby synchronized indexing is adjustable by controlling the stroke of an adjustable eccentric connecting rod, and whereby precise braked high speed intermittent pulling is accomplished.

Still another object is to provide a high speed adjustable indexing system for use with one or more types of metering devices.

Yet another object is to provide a system, as above, wherein a drum-type brake may be retrofit, or a disc-type braking arrangement may be employed, in either case facilitating speeds in excess of 6,000 stitches per minute.

The present invention fulfills the above-listed objectives, as well as many others and, in addition, overcomes the limitations and disadvantages of prior art solutions to conventional problems by providing a high speed adjustable indexing system which will hereinafter be described for and in terms of an industrial sewing machine and its associated puller attachment. The present system includes a braking arrangement which is capable of restraining either a roller equipped with a built-in clutch, or a shaft wherein the clutch is located remotely from the brake. A brake-lining member in the case of a split drum-type liner, or a pair of spaced discs in another embodiment, are caused under the adjustable biasing forces of a helical spring to produce an adjustable drag upon the rotating member against which the brake-lining is in contact. By knowing the running speed of a sewing machine, this spring pressure can be adjusted so as to provide truly synchronized high speed indexing. A predetermined area of contact between the brake liner and the surrounding structure causes a drawing off of heat produced within the brake liner member. In addition, wear, if any, is compensated for by the automatic adjustment of this same spring pressure.

This invention will be more clearly understood from the following description of specific embodiments of the invention, together with the accompanying drawings, wherein similar reference characters denote similar elements throughout the several views, and in which—

FIG. 1 is a perspective representation of a conventional sewing machine equipped with a puller attachment according to the present invention;

FIG. 4 is a fragmentary sectional elevational view taken along the line 4—4 of FIG. 1;

FIG. 5 is a sectional elevational view taken along the line 5—5 of FIG. 4;

FIG. 9 represents a fragmentary view of another embodiment of the present invention utilizing a split brake drum liner;

FIG. 10 is a sectional elevational view taken along the line 10—10 of FIG. 9; and FIG. 11 is a fragmentary sectional plan view taken along the line 11—11 of FIG. 9.

Figure 2:
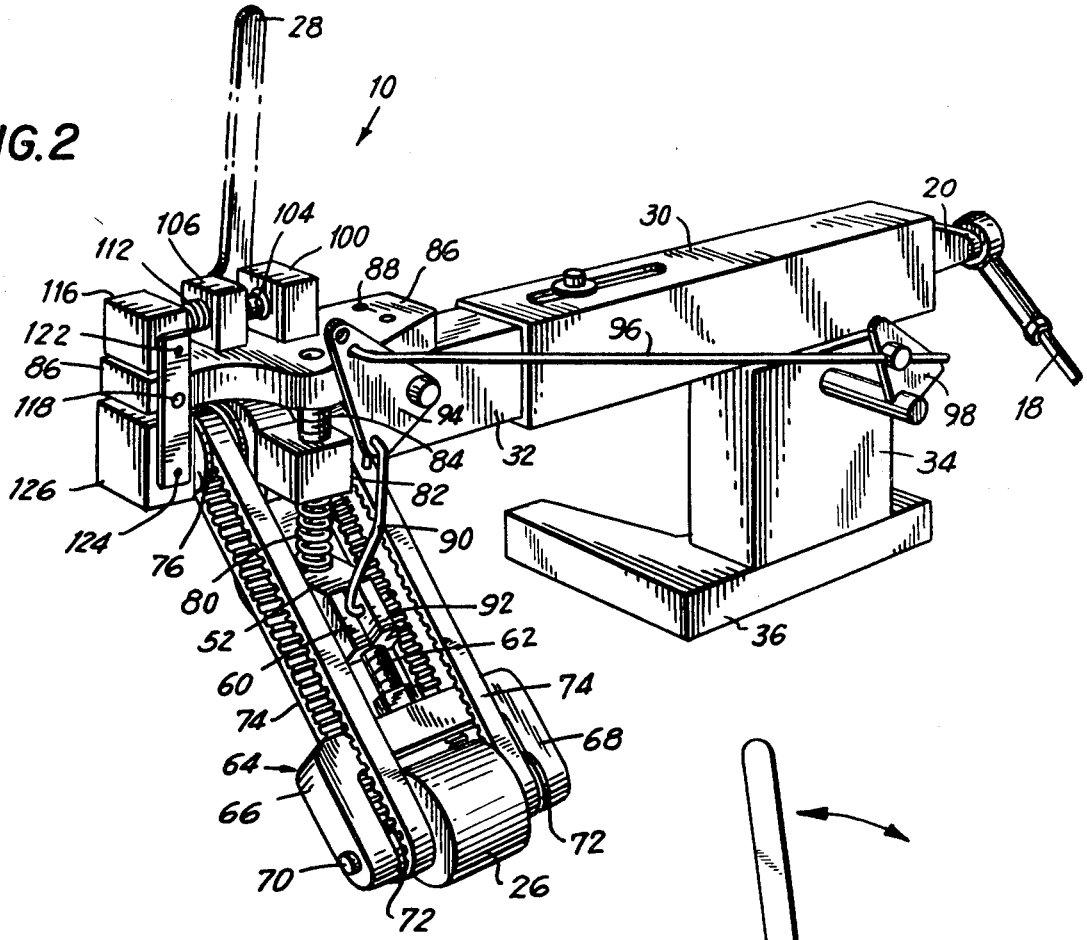
FIG. 2 is a perspective representation of the front of the puller attachment shown in FIG. 1.

Referring now in more detail to the drawings, FIGS. 1 and 2, perspective-type views, illustrate a puller attachment 10 secured by means of bolts 12 to a table 14 within which a sewing machine 16 is mounted. While it is unnecessary here to describe in detail the various parts of sewing machine 16, suffice it to say that the hand wheel driving mechanism of machine 16 carries an adjustable eccentric linkage arrangement, including a connecting rod 18, which interconnects the adjustable eccentric and rocking or operating lever 20.

Puller attachment 10 may be easily installed by a mechanic who will also attach an idler roller assembly 22 to the sewing machine cloth plate 24. Thus, once a mechanic or other personnel bolt these members down and attach the connecting rod 18 and its associated eccentric to the sewing machine hand wheel, the user is able to enjoy a puller attachment which affords (1) external stitch control at the hand wheel, (2) accurate synchronized high speed performance, and (3) duel lifting capability whereby the puller attachment roller 26 may be either independently lifted by means of a lifting handle 28, or when the presser foot is lifted, or both.

A substantially horizontal elongated rectangular housing 30 carries a telescoping extension 32 thereof which is slidably positionable within housing 30. Housing 30 is supported at a predetermined elevation by means of column 34 which, in turn, rests upon baseplate 36.

An elongated shaft 38, best seen in FIG. 4, extends from a one-way or infinite-type ratchet clutch assembly 40 at its input end, to a remote pulling end 42 thereof. Shaft 38 is journaled within a bearing 43 supported by block 44 located within the extremity of extension 32.

Figure 3:
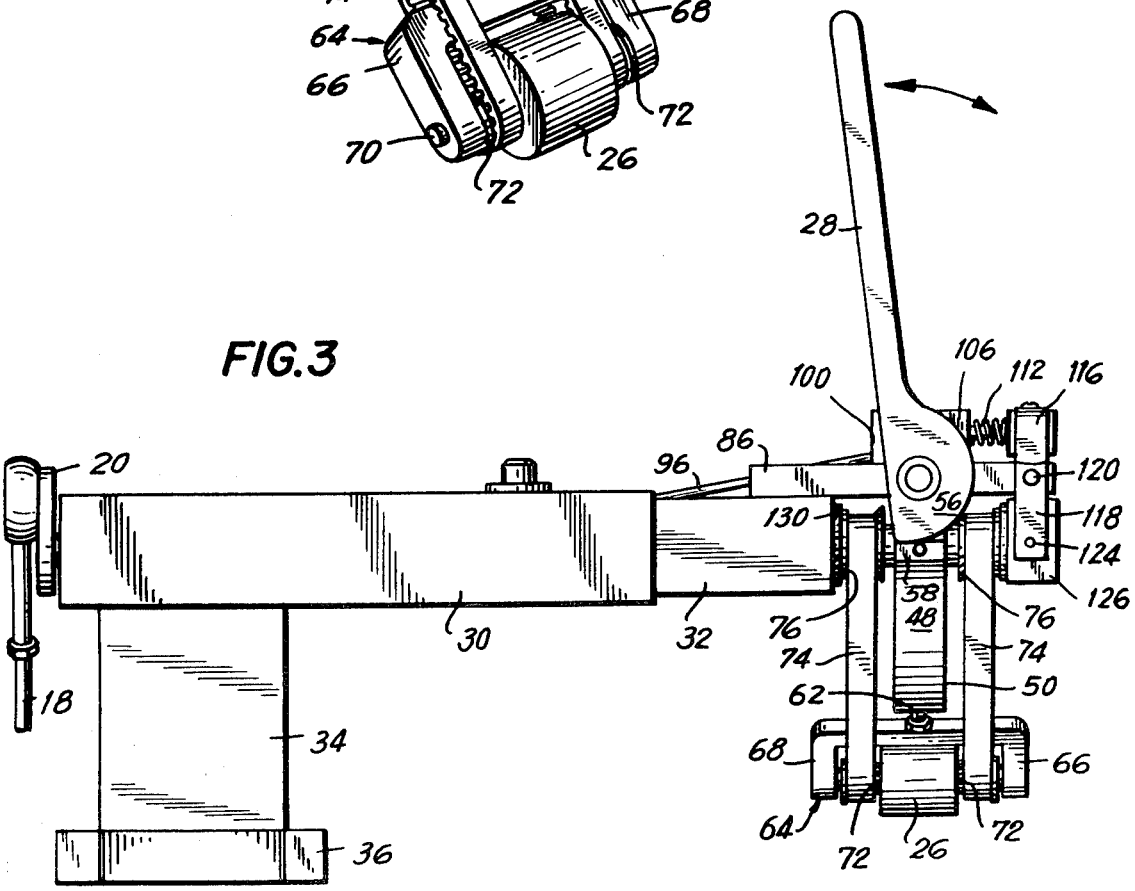
FIG. 3 is an elevational view, enlarged, illustrating a rear portion of the puller attachment shown in FIG. 2.

Shaft 38 carries a feed roll assembly 46, which includes a substantially centrally located L-shaped support member 48, which consists of a substantially vertical leg 50 integral with a substantially horizontal leg 52. A sleeve-type bearing 54 permits member 48 to freely rotatably move about shaft 38 such that, upon lifting handle 28 from the substantially horizontal position shown on FIG. 1 to a substantially vertical position best seen in FIG. 3, a cam portion 56 of handle 28 comes to bear against ledge 58 which is integral with member 48, thereby causing a rotation of the extremity 60 of horizontal leg 52 to rotate about the axis of shaft 38 away from the surface of cloth plate 24. This rotation of support member 48 results in a lifting of roller 26 from idler roller assembly 22 as a result of the integral interconnection of these structural components of the puller.

A threaded rod 62 interconnects extremity 60 and a U-shaped yoke member 64. Yoke member 64 includes a pair of substantially parallel legs 66 and 68 between which roller 26 is pivotally supported upon a shaft 70 journaled within legs 66 and 68. Shaft 70 further carries a pair of sprocket wheels 72, each of which carries a belt 74, which belts are driven at their upper extremities by collars or sprocket wheels 76. Sprocket wheels 76 are held integral with shaft 38 by means of setscrews 78 which lock them together.

Roller 26 is maintained against the idler roller of idler roller assembly 22 by means of a helical compression spring 80 which bears against the upper surfaces of horizontal leg 52 and lower surfaces of a block member 82. The position of block member 82 is controllable by means of adjusting bolt 84, thereby making variable and adjustable the pressure of roller 26 against the idler roller. Adjusting bolt 84 is carried by a horizontal support plate 86, which is bolted to extension 32 by bolts 88. Before looking at other portions of this invention carried by support plate 86, it is worth mentioning that roller 26 may also be lifted by means of a linkage interconnected with the foot pedal normally used to raise the presser foot of the sewing machine. A linking member 90 interconnects a boss 92 formed in extremity 60 of horizontal leg 52 and a rotatable wing plate 94 supported from extension 32. Wing plate 94, in turn, provides the link with a connecting rod 96 which, by means of plate 98, comprises a linkage interconnecting support member 48 with the machine foot pedal. Roller 26 may be lifted by means of lifting handle 28 or the linkage just described, or both.

Turning now once again to support plate 86, it can be seen in FIG. 4 that a block 100 is rigidly held integrally with and atop plate 86 by means of any one or more bolts 102. The head of an adjusting bolt 104 is supported within block 100 such that bolt 104 extends substantially horizontally above plate 86. A cup-shaped member 106 is formed with internal threads 108 which are threadedly carried by the external threads of the bolt 104. A recess 110 within member 106 houses one end of a helical spring 112, the opposite end of spring 112 being held within recess 114 of an opposing cup-shaped member 116. With the head of bolt 104 restrained from horizontal movement but permitted to rotate, rotation of bolt 104 in opposite directions will result the movement of member 106 in the direction of the arrows above it, thereby facilitating relatively precise control of the compressive forces of spring 112.

A pair of link members 118 are pivotally supported on a central pin 120 extending through support plate 86. Upper and lower pins 120 and 124 interconnect link members 118 on either side of the support plate 86 with cup-shaped member 116 and a bearing block 126 situated below plate 86. Bearing block 126 includes a vertical face 128 against which a braking disc 130 is exposed. Braking disc 130 is situated between face 128 and bearing surfaces 132 of sprocket wheel 76, and the disc is preferably adhered to a predetermined area of face 128 to enable the transfer and dissipation of heat generated within disc 130 during use. A second braking disc 134 is secured to face 136 of block 44 and, in much the same manner, bears against surfaces 138 of opposite sprocket wheel 76.

During rotation of shaft 38, sprocket wheels 76 which are integral therewith rotate with the shaft against the retarding friction forces caused by the presence of braking discs 130 and 134 bearing against their surfaces 132 and 138. The magnitude of these friction or drag forces is adjustable by means of rotation of bolt 104 which, when turned to cause increasing compressive forces within spring 112, will cause a movement of member 116 to the left as seen in FIG. 4, such that as a result of link members 118, bearing block 126 will move to the right as seen in the same FIG. 4, thereby causing increasing drag forces as a result of the pressure between braking discs 126 and 130. Decreases in these drag forces is accomplished by turning adjusting bolt 104 in the opposite direction.

In use, knowing the machine operating speeds of a customer who wishes to purchase puller attachment 10, one can adjust the pressure exerted by braking discs 130 and 134 by means of manipulating adjustment bolt 104, as just described. With the proper adjustment, a predetermined and adjustable drag or braking force is applied to shaft 38 and its associated hardware such that undesirable inertia-caused overshooting which would otherwise result when the drive mechanism stops is virtually eliminated. Speeds in excess of 6,000 stitches per minute are realizable with the present invention in a synchronized indexed adjustable system which can be adjusted for adjustable indexing as well. In addition, self-adjustment is realized in instances where the wear of braking discs 130 and 134 might otherwise cause a substantial decrease in braking pressure. In such instances, the compressive forces of helical spring 112 will automatically compensate for this wear allowance. More importantly, the braking system taught by this invention may be used with any indexing device, as will become apparent in the following discussion.

Figure 6:
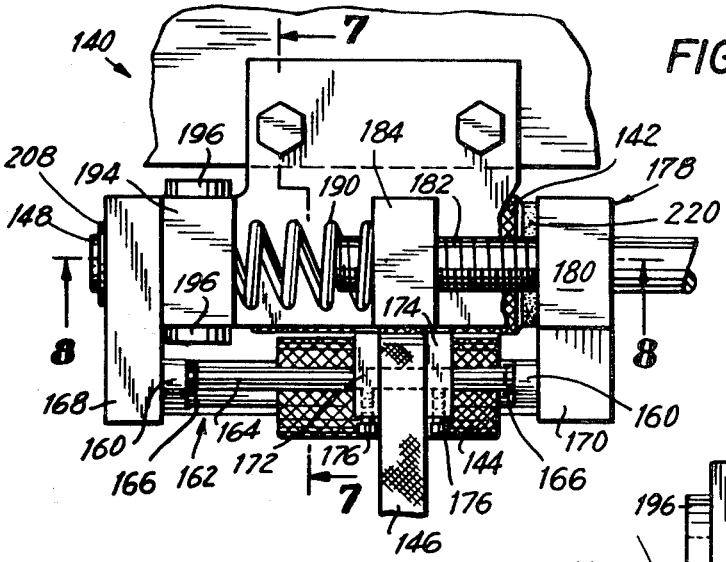
FIG. 6 is a fragmentary view of a metering device capable of feeding elastic and other materials according to the present invention.
Figure 7:
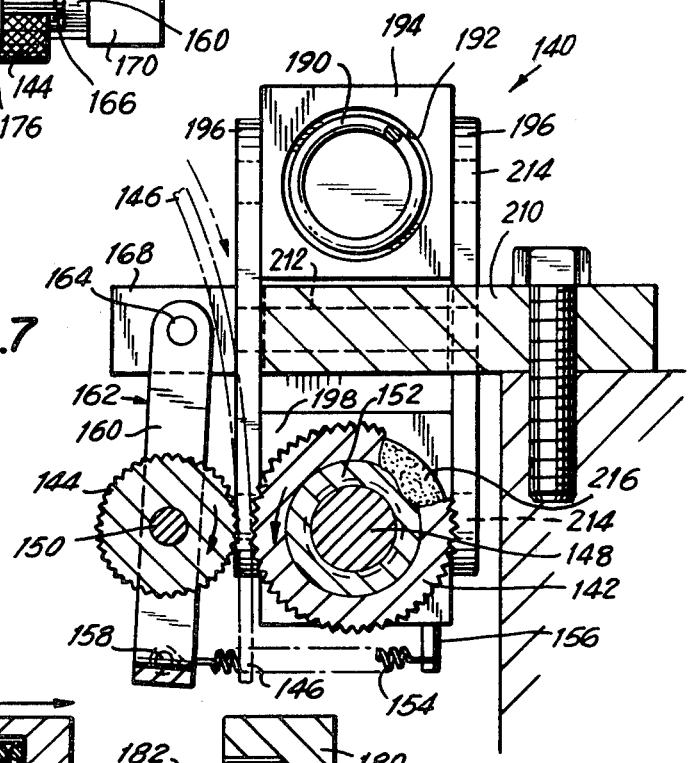
FIG. 7 is a sectional elevational view taken along the line 7—7 of FIG. 6.
Figure 8:
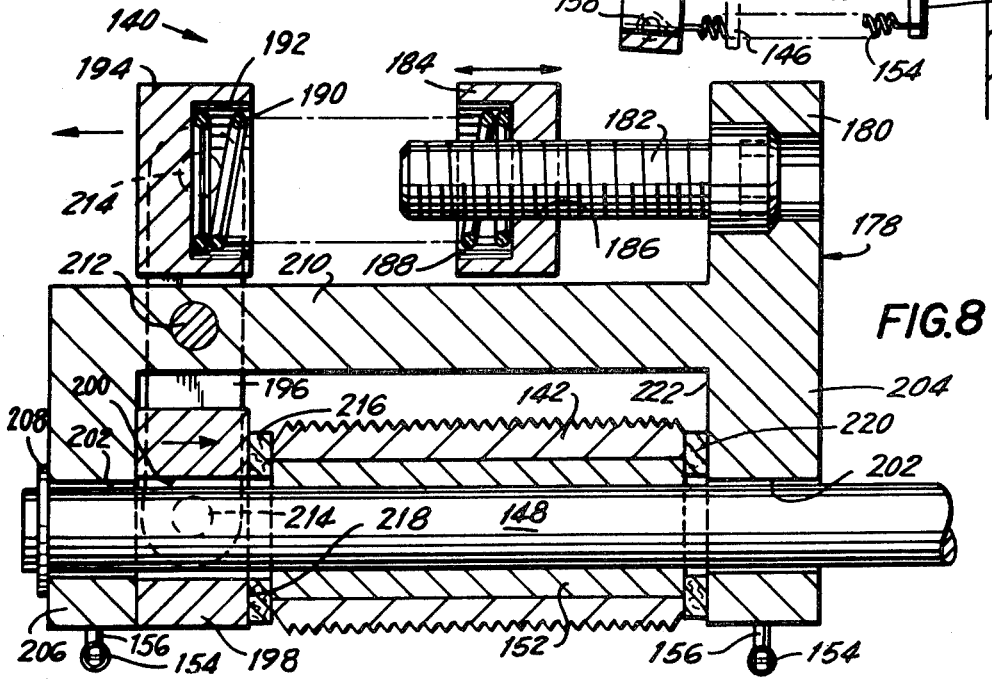
FIG. 8 is a sectional plan view taken along the line 8—8 of FIG. 6.

FIGS. 6, 7 and 8, illustrate in another embodiment of the present invention, a metering device in which is a high-speed synchronized system that will actually meter elastic, lace, ribbon, webbing, binding, waist bands and other materials at speeds in excess of 6,000 cycles or stitches per minute. Extremely accurate length matching on both stretch and non-stretch type materials is achieved with this high-speed synchronized metering device identified by reference character 140 in FIGS. 6, 7 and 8. A pair of knurled rollers 142 and 144 engage and feed elastic material 146, for example, in the direction shown by the arrow in FIG. 7 when rollers 142 and 144 rotate in the directions likewise shown in this figure. Roller 142 is carried by a shaft 148, while roller 144 is carried by shaft 150. In a preferred embodiment of this invention, a one-way ratchet or other type clutch 152 lies within the inner diameter of roller 142, such that this driven roller is able to rotate in only one direction - that of the direction of feeding of the material 146. Roller 144, on the other hand, is an idler roller which is biased toward roller 142 by means of a pair of helical springs 154 supported by pins 156 and 158, respectively.

Roller 144 and its supporting shaft 150 are carried by and between legs 160 of a U-shaped support 162. Legs 160 are journaled about a connecting shaft 164 which, in turn, is supported within sleeve bearings 166 carried by opposing support blocks 168 and 170. Guide plates 172 and 174 are independently adjustable along the length of shaft 164 such that material 146 of varying widths may be accommodated. Guide plates 172 and 174 are held in their respective desired positions by means of knurled-headed adjusting bolts 176. Thus, as best seen in FIG. 7, support 162 its associated roller 144 may be pivoted about shaft 164 toward or away from roller 142 against the tensile biasing forces of helical spring 154. This facilitates access to material 146 between the rollers and adjustment or feeding of the material there between.

A frame member 178 comprises the basis of support for metering device 140. In a preferred embodiment of this invention, frame member 178 consists of a one-piece casting of which support blocks 168 and 170 are an integral part. As best seen in FIG. 8, frame member 178 includes an outwardly projecting block portion 180 within which the head of an adjusting bolt 182 is journaled.

Adjusting bolt 182 carries a cup-shaped member 184, which is formed with both internal threads 186, cooperative with the external threads of bolt 182, and a recess 188 within which the end of helical spring 190 is situated. The opposite end of spring 190 is situated within a recess 192 formed in cup-shaped block 194.

Member 184 is "floating" in that rotation of bolt 182 will result in forward and rearward movement of member 184 along the shank of bolt 182. In this way, spring 190 is either compressed or elongated, thereby facilitating manipulation of and predetermined adjustment of the compressive forces within and exerted by spring 190.

Link members 196 interconnect block 194 with a bearing block 198 disposed coaxially with respect to shaft 148. Shaft 148 extends through an opening 200 through block 198 and is carried in bearings 202 within legs 204 and 206 of frame 178. A conventional retaining ring 208 holds shaft 148 in place.

Link members 196 are pivotally supported on the sides of a platform 210 of frame number 178. A shaft 212 interconnects and pivotally supports link members 196 and is shown in FIG. 8, extending through platform 210. Pins 214 interconnect link members 196 with blocks 194 and 198. Thus, compressive forces of spring 190 which bias block 194 to the left as shown in FIG. 8, causes block 198 to move to the right about the axis of shaft 212.

Block 198 carries a braking disc 216 which is preferably adhered to the face 218 of block 198. An opposing braking disc 220 is affixed to face 222 of leg 204 and these braking discs are biased against the end surfaces of roller 142 as a result of the forces exerted by helical spring 190.

It will now be clear that rotation of adjusting bolt 182 in a direction which compresses spring 190 (as a result of the movement of cup-shaped member 184) will result in increasing braking or drag forces exerted by discs 216 and 220 against the surfaces of roller 142, with the result that increased drag will tend to overcome an adjusted and predetermined magnitude the otherwise undesirable overshooting which occurs at higher running speeds.

FIGS. 9, 10 and 11 illustrate another approach according to the present invention wherein the braking or adjustable drag used to accomplish the high-speed indexing is accomplished using friction about and directly on a shaft itself. In other words, as opposed to utilizing parallel directional compressive spring forces through a linkage to cause discs to come into contact with rotating parts, as already described above, a braking sleeve 224 is employed in wrapped relationship about shaft 226 itself. Braking assembly 228, in addition to braking sleeve 224, comprises a pair of opposing block members 230 and 232. Block members 230 and 232 basically comprise two halves or opposing parts of what becomes a unitary assembly, designated reference character 228. Block 232 is formed with a pair of capped holes 234 and 236 into which a pair of bolts 238 and 240 respectively, extend.

Counterbored holes 242 and 244 formed through block member 230 accept bolts 238 and 240. In the case of bolt 238, a helical spring surrounds this bolt and, under compression, bears against the underside of the head of bolt 238 and the shoulder between the diameters of opening or hole 242.

Braking sleeve 224 consists of a split member wrapped around shaft 226, with a gap 248 defined by the proximate ends of sleeve 224. Sleeve 224 may be placed within the concave cavities 250 and 252 in the manner whereby the gap 248 is located to give either uniform or non-uniform drag results about the surface of shaft 226.

It is important to note here that, while not specifically shown in the drawings, shaft 226 is preferably, but not necessarily, integral with and cooperates with a one-way clutch that causes shaft 226 to move in an intermittent manner in unison with the movement of a sewing machine feed dog, for example. With machine speeds increasing in excess of those conventionally enjoyed, overshooting is eliminated by means of braking assembly 228 by the user having available to him the ability to adjust by means of turning bolt 238 the compressor forces within spring 246, such that a controlled accurate adjustment of the friction or drag of sleeve 224 on shaft 226 is realized. Tightening of bolt 238 into tapped opening 234 will increase the compressor forces within spring 246 such that a clamping-type action is enjoyed and sleeve 224 is urged against shaft 226 by the surfaces defining cavities 250 and 252. Loosening of bolt 238 accomplishes the opposite result.

It is to be noted that the embodiment of our invention shown in FIGS. 9–11 is especially, though not necessarily, suited in instances where the intermittently-driven shaft may simply be extended to permit an exposed area of drag contact. We wish to further point out that this invention contemplates a number of different arrangements whereby the clutch means providing one-way motion may be located within or adjacent rollers, distant from rollers, or in other cooperative physical relationship with respect to the driven rollers.

The embodiments of the invention particularly disclosed and described are presented merely as examples of the invention. Other embodiments, forms and modifications of the invention coming within the proper scope and spirit of the appended claims will, of course, readily suggest themselves to those skilled in the art.

What is claimed is:

1. A system for enabling relatively high-speed indexing of apparatus used to perform sewing operations on a fabric, comprising, in combination:

a shaft member, driving means, transmission means responsive to said driving means for transmitting one-way rotational intermittent indexed motion at high speed to said shaft member, roller assembly means spaced from said shaft member cooperatively responsive to said shaft member for pulling the fabric along a path from a stitching machine, said assembly means possessing an inertia of magnitude capable of being calculated, a base associated with said system, a support plate extending from said base adapted to support said shaft member, said support plate having a free end portion, a pin connected to said free end portion of said support plate disposed in perpendicular relationship with respect to the axis of said shaft member, a lever arm unit rotatably connected to said pin, said lever arm unit having a first portion on one side of said pin and a second portion on the other side of said pin, said first portion forming a first cup, a block member connected to said support plate and spaced from said second portion of said lever arm unit, said block member forming a counterbore, a movable member positioned between said block member and said second portion of said lever arm unit, said movable member forming a second cup opposed to and spaced from said first cup and further forming a threaded hole aligned with said second cup and with said counterbore, a helical compression spring positioned between said movable member and said second portion in said first and second cups, said spring being aligned approximately perpendicular to the alignment of said pin, a threaded bolt positioned in said counterbore of said block member and threadably mounted in said threaded hole of said movable member, and a bearing member spaced from said first portion of said lever arm unit and connected to said support plate, said bearing member having a shaftway, said shaft member being positioned in said shaftway, said shaft member having a free shaft end proximate to said first portion of said lever arm unit, a first braking disk disposed between said first portion of said lever arm unit and said free shaft end, and a second braking disk disposed around said shaft proximate to said bearing member, said roller assembly means being connected to said shaft member between said first and second disks, whereby when said bolt is screwed in to compress said spring, said lever arm unit compresses said first and second braking disks with said shaft member to selectively inhibit the rotation of said shaft member and for controlling normally undesirable interia-influenced motion of said roller assembly means.

* * * * *